US007521869B2

(12) United States Patent
Nieuwland et al.

(10) Patent No.: US 7,521,869 B2
(45) Date of Patent: Apr. 21, 2009

(54) ELECTRIC DISCHARGE LAMP WITH HALIDE RESISTANT CONDUCTOR

(75) Inventors: Govert Nieuwland, Eindhoven (NL); Johannes Franciscus Maria Cillessen, Eindhoven (NL); Henricus Albertus Maria Van Hal, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 411 days.

(21) Appl. No.: 10/562,884

(22) PCT Filed: Jun. 28, 2004

(86) PCT No.: PCT/IB2004/051023

§ 371 (c)(1),
(2), (4) Date: Dec. 29, 2005

(87) PCT Pub. No.: WO2005/001883

PCT Pub. Date: Jan. 6, 2005

(65) Prior Publication Data

US 2006/0250088 A1 Nov. 9, 2006

(30) Foreign Application Priority Data

Jun. 30, 2003 (EP) ..... 03101953

(51) Int. Cl.
*H01J 61/36* (2006.01)

(52) U.S. Cl. ..... 313/623

(58) Field of Classification Search ..... 313/623; 252/500, 502; 428/565
See application file for complete search history.

(56) References Cited

U.S. PATENT DOCUMENTS 4,880,707 A * 11/1989 Kohno et al. ..... 428/565
5,795,837 A * 8/1998 Wei et al. ..... 501/87
2005/0029949 A1* 2/2005 Cillessen et al. ..... 313/625

FOREIGN PATENT DOCUMENTS

WO 0034980 A1 6/2000
WO 03060951 A1 7/2003

OTHER PUBLICATIONS

Bohn et al., Structural materials: metal-silicon-boron, Elsevier, Journal of Alloys and Compounds 347 (2002), p. 94-100.*

* cited by examiner

*Primary Examiner*—Toan Ton
*Assistant Examiner*—Hana A Sanei

(57) ABSTRACT

An electric discharge lamp comprising: a light-transmissive ceramic discharge vessel (1); a first and a second current conductor (2,3) entering the discharge vessel (1)and each supporting an electrode (4,5) in the discharge vessel (1); an ionizable filling comprising a rare gas and a metal halide in the discharge vessel (1); at least the first current conductor (2) within the discharge vessel (1) being halide-resistant, characterized in that the first current conductor (2) at least substantially comprises a material with an at least substantially isotropic coefficient of thermal expansion, said material preferably being chosen from the group of $Y_pSi_3X_q$, wherein Y is chosen from Mo, W and Ta and X is B, Al, N or C with 4<p:5 5 and 0<q<1. More preferably, said material is of the composition Mo6($Si_x$, Moi-X)4($C_y$, Si1-$_y$)6 with 0.10:5 x<0.55 and 0.15<y:S 0.40.

15 Claims, 1 Drawing Sheet

ELECTRIC DISCHARGE LAMP WITH HALIDE RESISTANT CONDUCTOR

Figure 1:
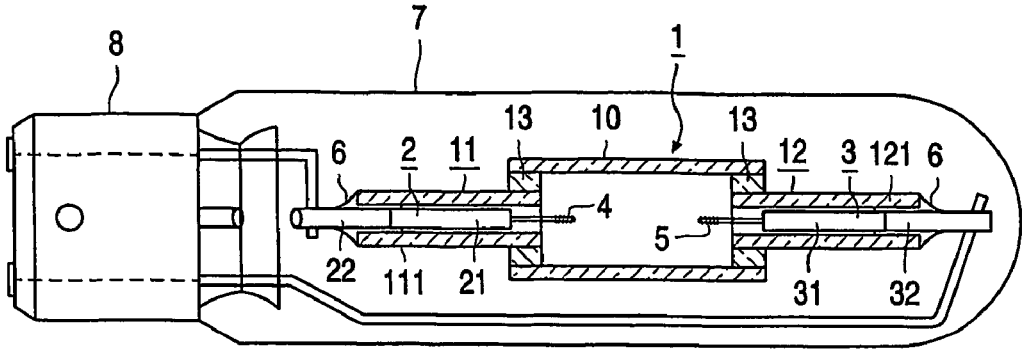

The invention relates to an electric discharge lamp comprising:

a light-transmissive ceramic discharge vessel;

a first and a second current conductor entering the discharge vessel and each supporting an electrode in the discharge vessel;

an ionizable filling comprising a rare gas and a metal halide in the discharge vessel; at least the first current conductor within the discharge vessel being halide-resistant.

Such an electric discharge lamp is known from patent publication WO0034980. A first part of the first current conductor consists of a halide-resistant material, whereas the second part thereof is made of niobium. Niobium is chosen because this material has a coefficient of thermal expansion corresponding to that of the discharge vessel, so that leakage of the lamp is prevented. In a particular prior art embodiment, said first part is made of pentamolybdenum trisilicide in order to obviate the risk of leakage in the case where the sealing compound, being either a ceramic, a glass or a combination thereof, also directly connects the first part of the first current conductor to the lamp.

A ceramic discharge vessel in this description and claims is understood to be a discharge vessel having a wall made of a translucent crystalline metal oxide such as, for example, monocrystalline sapphire and densely sintered polycrystalline metal oxide such as, for example, alumina, YAG, or YbAG.

A disadvantage of the electric discharge lamp known from the cited patent publication is that if said first part of the first current conductor is made of pentamolybdenum trisilicide, microcracks may occur in this material when it is sintered, particularly at high temperatures and/or densities. These microcracks limit the mechanical strength of the first current conductor and/or may partly "absorb" the ionizable filling in the discharge vessel. Furthermore, the microcracks introduce porosity, which may result in leakage, as indicated above.

It is an object of the present invention to obviate this disadvantage.

In order to accomplish that objective, an electric discharge lamp of the type referred to in the opening paragraph is characterized according to the invention in that the first current conductor at least substantially comprises a material with an at least substantially isotropic coefficient of thermal expansion. Said material is preferably chosen from the group of $Y_pSi_3X_q$ wherein Y is selected from Mo, W and Ta and X is B, Al, N or C with $4 \leqq p \leqq 5$ and $0 < q \leqq 1$, belonging to a group of materials having a structure of type $D8_8$, also known as Novotny phases. An advantageous aspect of these materials is that they are substantially single-phase. Preferably, the material is of the composition $Mo_6(Si_x, Mo_{1-x})_4(C_y, Si_{1-y})_6$ with $0.10 \leqq x \leqq 0.55$ and $0.15 \leqq y \leqq 0.40$. Extensive research has revealed that the above-mentioned microcracks can be attributed to specific thermoelastic properties of pentamolybdenum trisilicide leading to thermal stresses therein. The invention is particularly based on the recognition that the thermoelastic properties of the material used can be improved and that thermal stresses therein can be prevented by proposing a material that has an at least substantially isotropic coefficient of thermal expansion, i.e. a coefficient of thermal expansion exhibiting similar values in all crystallographic directions of the crystal structure of the material used. The essential properties of the invented material are retained when Y is composed of a mixture chosen from two of more of the elements Mo, W and Ta. In accordance with the invention, particularly $Y_pSi_3X_q$, wherein Y is chosen from Mo, W and Ta and X is B, Al, N or C with $4 \leqq p \leqq 5$ and $0 < q \leqq 1$, more in particular $Mo_6(Si_x, Mo_{1-x})_4(C_y, Si_{1-y})_6$ with $0.10 \leqq x \leqq 0.55$ and $0.15 \leqq y \leqq 0.40$, appears to have an (almost) isotropic coefficient of thermal expansion while retaining its close correspondence to the thermal expansion of the discharge vessel. A further advantage is that these materials are substantially of a single phase. Simultaneously it meets other requirements: resistant to the ionizable filling of the lamp, particularly to halide (i.e. they should not be attacked by or react with halide or halogen formed therefrom), able to withstand thermal manufacturing and operating conditions of the lamp, thermally stable up to 2000° C., capable of being attached to the electrode, and having sufficient electrical conductivity to preclude electrical losses.

In one preferred embodiment of an electric discharge lamp according to the invention, also the second current conductor at least substantially comprises a material with an at least substantially isotropic coefficient of thermal expansion, said material preferably being of the composition $Mo_6(Si_x, Mo_{1-x})_4(C_y, Si_{1-y})_6$ with $0.10 \leqq x \leqq 0.55$ and $0.15 \leqq y \leqq 0.40$. This simplifies the manufacture of the lamp, as the same components are used for both current conductors. As indicated earlier, these materials ideally meet the requirements of being thermally and chemically stable and having an isotropic coefficient of thermal expansion.

In another preferred embodiment of an electric discharge lamp according to the invention, said material adheres to the ceramic material of the discharge vessel at the manufacturing temperature of the lamp. This allows a very compact lamp construction for the following reasons. The prior art lamp as described in the cited patent publication makes use of a sealing compound for sealing the ceramic discharge vessel around the current conductors. As the sealing compound is sensitive to high (operating) temperatures of the lamp, the sealing compound is applied as remote as possible from a central part of the discharge vessel, i.e. at a free end of projecting plugs (i.e. elongated end parts) that are connected to the central part of the discharge vessel by means of sintering. The use of said projecting plugs also has some drawbacks from the point of view of lamp design and operation. Said plugs function as cooling fins, thereby influencing the operating temperature in the discharge vessel during lamp operation, thus imposing restrictions in designing a lamp. Besides, capillaries are introduced in said projecting plugs, into which part of the lamp filling will distil, which may result in color instability of the lamp. In the present preferred embodiment, the claimed material $Y_pSi_3X_q$, wherein Y is chosen from Mo, W and Ta and X is B, Al, N or C, with $4 \leqq p \leqq 5$ and $0 < q \leqq 1$, being substantially singe-phase, is co-sintered to the ceramic discharge vessel at a manufacturing temperature varying between 1500 and 2000° C. The use of a separate sealing compound is thus excluded, and the use of projecting plugs as part of the discharge vessel can be avoided as well. In the preferred embodiment full advantage is taken of the close matching of the thermal expansion of the ceramic material of the discharge vessel and that of the current conductor material. The present preferred embodiment enables a very compact lamp construction to be achieved, while obviating the prior art disadvantages discussed above.

In another preferred embodiment of an electric discharge lamp according to the invention, the first and the second current conductor each extend from a sealing compound, which seals the discharge vessel around the current conductors in a gastight manner to the exterior of the discharge vessel, and the discharge vessel has projecting plugs, in each of which a respective current conductor is enclosed and which each have a free end where the discharge vessel is sealed by adhesion to the sealing compound.

Figure 2:
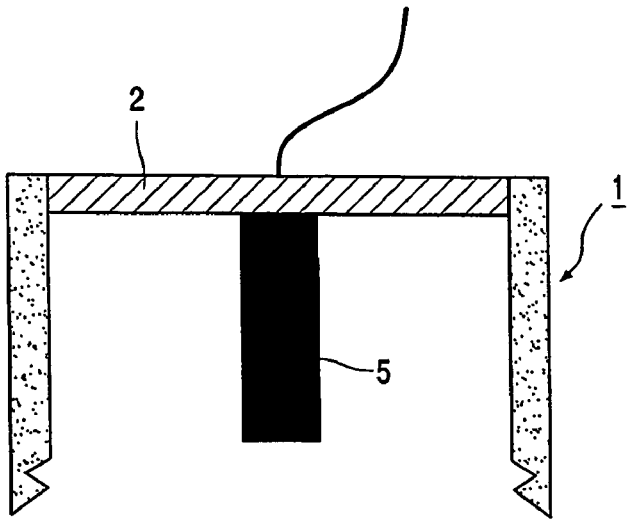
Figure 3:
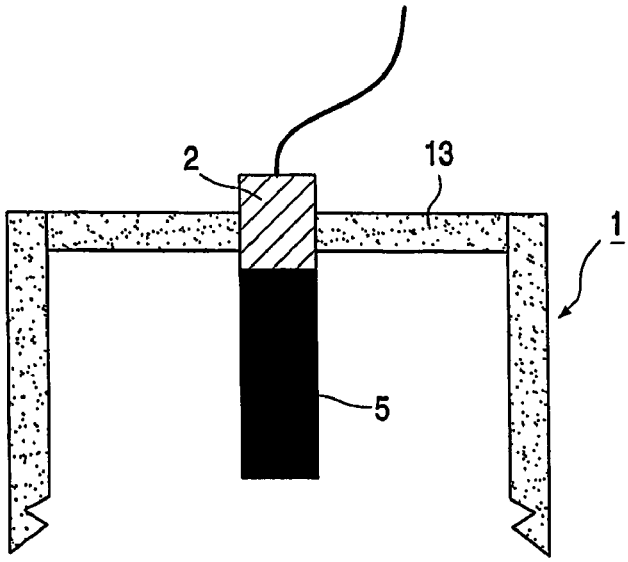

The invention will now be explained in more detail with reference to a drawing in which:

FIG. 1 diagrammatically shows a high-pressure discharge lamp according to the invention;

FIG. 2 shows in cross-section an alternative closure construction of a discharge vessel of the lamp from FIG. 1, and FIG. 3 shows a further alternative closure of the discharge vessel of the lamp from FIG. 1.

FIG. 1 shows an electric discharge lamp in accordance with the invention provided with a tubular, light-transmissive, ceramic discharge vessel 1 made from polycrystalline aluminum oxide, with a first and a second current conductor 2,3. Said conductors 2,3 enter the discharge vessel 1 opposite each other and each support a tungsten electrode 4,5 present in the discharge vessel 1 and welded to the respective current conductor 2,3. A ceramic sealing compound 6 formed in a melting process by 30% by weight of aluminum oxide, 40% by weight of silicon oxide and 30% by weight of dysprosium oxide, seals the current conductors 2,3 in a gastight manner. The discharge vessel 1 has an ionizable filling comprising argon as a rare gas and a mixture of sodium, thallium and dysprosium iodides as metal halides.

The first and the second current conductor 2,3 each have a first halide-resistant part 21,31 within the discharge vessel 1 and, extending from the sealing compound 6 to the exterior of the discharge vessel 1, a second part 22,32 welded to the first part 21,31. The second part 22,32 of the current conductor 2,3 consists of niobium and is entirely incorporated in the sealing compound 6 within the discharge vessel 1. In accordance with the invention, the first part 21,31 of the first and the second current conductor 2,3 consists of a material with an isotropic coefficient of thermal expansion, which material is preferably $Y_pSi_3X_q$ wherein Y is chosen from Mo, W and Ta and X is B, Al, N or C with $4 \leqq p \leqq 5$ and $0 < q \leqq 1$, and more preferably of the composition $Mo_6(Si_x, Mo_{1-x})_4(C_y, Si_{1-y})_6$ with $0.10 \leqq x \leqq 0.55$ and $0.15 \leqq y \leqq 0.40$, which materials are substantially single-phase. In an alternative embodiment, both current conductors 2,3 are made in one piece of one material according to the invention. Consequently, the use of a second part 22,32 of niobium is avoided, which results in an advantageous simplification of lamp construction, so in a simpler lamp fabrication process. This is possible because $Y_pSi_3X_q$, wherein Y is chosen from Mo, W and Ta and X is B, Al, N or C with $4 \leqq p \leqq 5$ and $0 < q \leqq 1$, has a coefficient of thermal expansion which closely matches that of the ceramic material of the vessel 1.

The discharge vessel 1 has narrow end parts or projecting plugs 11,12, in each of which a respective current conductor 2,3 is enclosed. The plugs 11,12 each have a free end 111,121, where the sealing compound 6 seals the discharge vessel 1. The central part 10 of the discharge vessel 1 is connected by means of sintering to the plugs 11,12 via ceramic discs 13. The discharge vessel 1 is provided with an outer envelope 7 sealed in a gastight manner and evacuated or filled with an inert gas in order to protect the niobium second parts 22,32 of the current conductors 2,3. The outer envelope 7 supports a lamp cap 8.

FIG. 2 schematically shows one end of a tubular, light-transmissive, ceramic discharge vessel 1 in accordance with another preferred embodiment, wherein a very compact lamp construction is obtained. The tungsten electrode 5 present in the discharge vessel 1 is attached (preferably welded) to the first current conductor 2. Said first current conductor 2 is co-sintered to the material of the ceramic discharge vessel 1 at a lamp manufacturing temperature varying between 1500 and 2000° C., without using a separate sealing compound, contrary to the lamp shown in FIG. 1. The current conductor 2 consists of the same material as specified for the first current conductor 2 of FIG. 1. The first current conductor 2 of FIG. 2 forms an end wall of the ceramic discharge vessel 1. Alternatively, as shown in FIG. 3, the current conductor 2 forms an extension of the electrode 5 extending through the ceramic disc 13 of the discharge vessel 1. The other end of the ceramic discharge vessel (not shown in FIGS. 2 and 3) may have the same construction.

The invention is not restricted to the versions shown in the drawing, but also includes other embodiments that fall within the scope of the appended claims.

The invention claimed is:

1. An electric discharge lamp comprising:

a light-transmissive ceramic discharge vessel;

a first and a second current conductor entering the discharge vessel and each supporting an electrode in the discharge vessel;

an ionizable filling comprising a rare gas and a metal halide in the discharge vessel;

at least the first current conductor within the discharge vessel being halide-resistant, wherein the first current conductor at least substantially includes a material with an at least substantially isotropic coefficient of thermal expansion, wherein said material of the first current conductor is chosen from the group of $Y_pSi_3X_q$, wherein Y is chosen from Mo, W and Ta and X is B, Al, N or C with $4 \leqq p \leqq 5$ and $0 < q \leqq 1$, and wherein said material of the first current conductor is co-sintered to the ceramic material of the discharge vessel at a manufacturing temperature of the lamp.

2. The electric discharge lamp of claim 1, wherein also the second current conductor least substantially includes a material with an at least substantially isotropic coefficient of thermal expansion.

3. The electric discharge lamp of claim 2, wherein said material of the second current conductor is of the composition $Mo_6(Si_x, Mo_{1-x})_4(C_y, Si_{1-y})_6$ with $0.10 \leqq x \leqq 0.55$ and $0.15 \leqq y \leqq 0.40$.

4. The electric discharge lamp of claim 2, wherein said material of the second current conductor is chosen from the group of $Y_pSi_3X_q$, wherein Y is chosen from Mo, W and Ta and X is B, Al, N or C with $4 \leqq p \leqq 5$ and $0 < q \leqq 1$.

5. The electric discharge lamp of claim 1, wherein the first and the second current conductor each extend from a sealing compound , which seals the discharge vessel around the current conductors in a gastight manner, to the exterior of the discharge vessel, and wherein the discharge vessel has projecting plugs in each of which a respective current conductor is enclosed and which plugs each have a free end where the discharge vessel is sealed by the sealing compound.

6. The electric discharge lamp of claim 1, wherein the first current conductor further includes a material with a coefficient of thermal expansion corresponding to a coefficient of thermal expansion of the discharge vessel.

7. An electric discharge lamp comprising:

a light-transmissive ceramic discharge vessel;

a first and a second current conductor entering the discharge vessel and each supporting an electrode in the discharge vessel;

an ionizable filling comprising a rare gas and a metal halide in the discharge vessel;

at least the first current conductor within the discharge vessel being halide-resistant, wherein the first current conductor at least substantially includes a material with an at least substantially isotropic coefficient of thermal expansion, and wherein said material of the first current conductor is of the composition $Mo_6(Si_x, Mo_{1-x})_4(C_y, Si_{1-y})_6$ with $0.10 \leqq x \leqq 0.55$ and $0.15 \leqq y \leqq 0.40$.

8. The electric discharge lamp of claim 7, wherein the first current conductor further includes a material with a coefficient of thermal expansion corresponding to a coefficient of thermal expansion of the discharge vessel.

9. The electric discharge lamp of claim 7, wherein also the second current conductor at least substantially includes a material with an at least substantially isotropic coefficient of thermal expansion.

10. The electric discharge lamp of claim 9, wherein said material of the second current conductor is of the composition $Mo_6(Si_x, Mo_{1-x})_4(C_y, Si_{1-y})_6$ with $0.10 \leqq x \leqq 0.55$ and $0.15 \leqq y \leqq 0.40$.

11. The electric discharge lamp of claim 7, wherein said material is co-sintered to the ceramic material of the discharge vessel at a manufacturing temperature of the lamp.

12. The electric discharge lamp of claim 7, wherein the first and the second current conductor each extend from a sealing compound which seals the discharge vessel around the current conductors in a gastight manner, to the exterior of the discharge vessel, and wherein the discharge vessel has projecting plugs in each of which a respective current conductor is enclosed and which plugs each have a free end where the discharge vessel is sealed by the sealing compound.

13. An electric discharge lamp comprising:

a light-transmissive ceramic discharge vessel;

a first and a second current conductor entering the discharge vessel and each supporting an electrode in the discharge vessel;

an ionizable filling comprising a rare gas and a metal halide in the discharge vessel;

at least the first current conductor within the discharge vessel being halide-resistant, wherein the first current conductor and the second current conductor at least substantially include a material with an at least substantially isotropic coefficient of thermal expansion, wherein said material of the first current conductor is chosen from the group of $Y_pSi_3X_q$, wherein Y is chosen from Mo, W and Ta and X is B, Al, N or C with $4 \leqq p \leqq 5$ and $0 < q \leqq 1$, and wherein said material of the second current conductor is of the composition $Mo_6(Si_x, Mo_{1-x})_4(C_y, Si_{1-y})_6$ with $0.10 \leqq x \leqq 0.55$ and $0.15 \leqq y \leqq 0.40$.

14. The electric discharge lamp of claim 13, wherein the first current conductor further comprises a material with a coefficient of thermal expansion corresponding to a coefficient of thermal expansion of the discharge vessel.

15. The electric discharge lamp of claim 13, wherein the first and the second current conductor each extend from a sealing compound, which seals the discharge vessel around the current conductors in a gastight manner, to the exterior of the discharge vessel, and wherein the discharge vessel has projecting plugs in each of which a respective current conductor is enclosed and which plugs each have a free end where the discharge vessel is sealed by the sealing compound.

* * * * *